US009032870B2

(12) United States Patent
Zhang et al.

(10) Patent No.: US 9,032,870 B2
(45) Date of Patent: May 19, 2015

(54) SORTING AND BUNDLING ALL-IN-ONE MACHINE AND BANKNOTE STACKING AND SORTING MODULE THEREOF

(71) Applicant: GRG Banking Equipment Co., Ltd., Guangzhou, Guangdong (CN)

(72) Inventors: Wei Zhang, Guangzhou (CN); Ting Zhang, Guangzhou (CN); Wenqing Wu, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/353,554

(22) PCT Filed: Oct. 26, 2012

(86) PCT No.: PCT/CN2012/083578

§ 371 (c)(1),
(2) Date: Apr. 23, 2014

(87) PCT Pub. No.: WO2013/086904

PCT Pub. Date: Jun. 20, 2013

(65) Prior Publication Data

US 2014/0238251 A1 Aug. 28, 2014

(30) Foreign Application Priority Data

Dec. 16, 2011 (CN) ..... 2011 1 0424787

(51) Int. Cl.
*B65B 13/20* (2006.01)
*B65B 13/02* (2006.01)
(Continued)

(52) U.S. Cl.
CPC ..... *B65B 13/02* (2013.01); *B65B 13/20* (2013.01); *Y10S 414/12* (2013.01);
(Continued)

(58) Field of Classification Search
CPC ..... B65B 13/02; B65B 13/20; G07D 11/006; Y10S 414/12; B65H 31/3045; B65H 2405/52; B65H 2405/5812; B65H 2701/1912; B65H 2301/42242
USPC ..... 100/3, 7, 233; 271/207, 213, 214, 215, 271/218; 414/907
See application file for complete search history.

(56) References Cited

U.S. PATENT DOCUMENTS 3,312,161 A * 4/1967 Nanna ..... 99/377
4,547,112 A * 10/1985 Steinhart ..... 414/788.3
(Continued)

FOREIGN PATENT DOCUMENTS

CN 1654292 A 8/2005
CN 1320099 A 11/2005
(Continued)

OTHER PUBLICATIONS

International Search Report dated Feb. 7, 2013 from corresponding International Application No. PCT/CN2012/083578.

*Primary Examiner* — Jimmy T Nguyen
(74) *Attorney, Agent, or Firm* — Wolf, Greenfield & Sacks, P.C.

(57) ABSTRACT

A banknote stacking and sorting module comprises a banknote clamping and conveying sub-module, which comprises a clamping mechanism and a vertical reciprocating mechanism thereof. Clamping mechanism comprises bearing plate, support, cam, clamping rod and clamping spring. Cam is rotatably mounted on support. Clamping rod comprises clamping end, transmission end and hinged part between clamping end and transmission end. Hinged part of clamping rod is hinged on support. Cam engages with transmission end of clamping rod and can drive clamping rod in rotation around second rotary shaft between released position and clamped position. One end of clamping spring is fixed on support and the other end is connected to clamping end of clamping rod so as to provide to clamping rod an elastic force for clamping banknotes.

10 Claims, 7 Drawing Sheets

(51) Int. Cl.
*B65H 31/30* (2006.01)
*G07D 11/00* (2006.01)

(52) U.S. Cl.
CPC ..... *B65H 31/3045* (2013.01); *B65H 2405/52* (2013.01); *B65H 2405/5812* (2013.01); *B65H 2701/1912* (2013.01); *G07D 11/006* (2013.01); *Y10S 414/117* (2013.01)

(56) References Cited

U.S. PATENT DOCUMENTS 5,018,717 A * 5/1991 Sadwick et al. ..... 271/207
2003/0082044 A1 * 5/2003 Gendron et al. ..... 414/789.9
2011/0011774 A1 1/2011 Yokota et al.

FOREIGN PATENT DOCUMENTS

| | | | |
|---|---|---|---|
| CN | 1891600 | A | 1/2007 |
| CN | 101249910 | A | 8/2008 |
| CN | 201362521 | Y | 12/2009 |
| CN | 201673552 | U | 12/2010 |
| CN | 201892982 | U | 7/2011 |
| CN | 102249111 | A | 11/2011 |
| EP | 0559992 | A2 | 9/1993 |
| JP | 2006309681 | A | 11/2006 |

* cited by examiner

SORTING AND BUNDLING ALL-IN-ONE MACHINE AND BANKNOTE STACKING AND SORTING MODULE THEREOF

The present application is the national phase of International Application No. PCT/CN2012/083578, filed on Oct. 26, 2012, which claims the benefit of priority to Chinese Patent Application No. 201110424787.0 titled "SORTING-BUNDLING INTEGRATED APPARATUS AND BANKNOTE STACKING AND TIDYING MODULE THEREOF", filed with the Chinese State Intellectual Property Office on Dec. 16, 2011, which applications are hereby incorporated by reference to the maximum extent allowable by law.

FIELD OF THE INVENTION

The present application relates to a financial apparatus and a mechanism for pressing a stack of sheet media thereof, and particularly to a sorting-bundling integrated apparatus and a banknote stacking and tidying module thereof.

BACKGROUND OF THE INVENTION

With the development and progress of science and technology, in some companies that need to handle large amounts of cash, previous backward manual procedures, such as counting, hundred separating, bundling and packaging, have been gradually replaced by various types of advanced automatic processing systems. Existing sorting-bundling integrated apparatuses may achieve the above actions such as counting, hundred separating and bundling. Before bundling the hundred-separated banknotes, the apparatus must press tightly the banknotes which are stacked tidily and then convey the pressed banknotes to a bundling module for being bundled.

For a conventional mechanism for pressing a stack of sheet media, normally, a linear pressing mechanism is installed along the thickness direction of sheet media. Such a linear pressing mechanism mostly takes up much space in arrangement and cannot be hidden into other functional sub-modules completely, and if being provided in an area where various functional modules act together, such a linear pressing mechanism may affect the operation of other functional modules, thus it is difficult to implement.

Therefore, it is necessary to provide a sheet medium pressing mechanism which saves space in arrangement.

SUMMARY OF THE INVENTION

The object of the present application is to provide a banknote stacking and tidying module which saves space in arrangement and does not affect the operating of other functional modules, and a sorting-bundling integrated apparatus having the banknote stacking and tidying module.

The banknote stacking and tidying module includes a banknote tidying sub-module, a banknote stacking sub-module and a banknote pressing and conveying sub-module, wherein the banknote pressing and conveying sub-module includes a pressing mechanism, a pressing mechanism vertical reciprocating movement unit and a banknote horizontal conveying carriage. The pressing mechanism includes a receiving plate, a bracket fixed on the receiving plate, a cam, a pressing rod and a pressing spring, wherein the cam is rotatably mounted on the bracket by means of a first rotating shaft, the pressing rod includes a pressing end, a driving end and an articulating portion between the pressing end and the driving end, the articulating portion of the pressing rod is articulated on the bracket by means of a second rotating shaft, the cam is cooperated with the driving end of the pressing rod to drive the pressing rod to rotate about the second rotating shaft between a release position and a pressing position, one end of the pressing spring is fixed on the bracket, and the other end of the pressing spring is connected to the pressing end of the pressing rod for applying an elastic force to the pressing rod to press banknotes tightly. The pressing mechanism vertical reciprocating movement unit includes a slider and a guide bar, wherein the slider is disposed around the guide bar such as to move upwardly and downwardly along the guide bar, the receiving plate is fixedly connected with the slider such as to move upwardly and downwardly along the guide bar together with the slider. The banknote horizontal conveying carriage includes a receiving surface and a banknote pressing arm, and is adapted to receive and clamp the banknotes stacked and pressed and to convey the banknotes to a banknote bundling module horizontally.

Preferably, the cam the cam has a discontinuity outline including, in sequence, a first arc, an involute tangent to the first arc, a second arc tangent to the involute, and a third arc. The centre of the base circle of the involute is the axle center of the first rotating shaft, and the center of the third arc coincides with the center of the base circle of the involute. Since the center of the third arc coincides with the center of the base circle of the involute, the pressing rod can stay at the release position when the pressing rod reaches a release position, i.e. when a motor driving the pressing rod stops running.

Preferably, a rolling wheel is provided at the driving end of the pressing rod and is in contact with the cam.

Preferably, the pressing spring is a torsion spring disposed around the second rotating shaft, with one end of the torsion spring abutting against the bracket and the other end of the torsion spring abutting against the pressing end of the pressing rod.

Preferably, a portion of the pressing end of the pressing rod for pressing the banknotes is a small flat plate, and the bottom of the flat plate is concaved slightly for bonding a material with a greater frictional coefficient than that of the pressing rod. In this way, the frictional force between the pressing rod and the banknotes may be increased, and thus the banknotes can be pressed more effectively without loosening or shifting.

Preferably, a travel constraint groove is provided in the bracket, and the driving end of the pressing rod is provided with a boss projecting into the travel constraint groove. The pressing rod is limited at the release position or the pressing position by a corresponding end of the travel constraint groove.

Preferably, the banknote pressing and conveying sub-module further includes a sensor including a sensing baffle and a sensor body. The sensor body is an optical "U"-shaped sensor or a thru-beam sensor and is fixedly connected to the bracket or the receiving plate. The sensing baffle is fixedly connected to the driving end of the pressing rod and moves as the pressing rod rotates, so as to block an optical path of the sensor body selectively.

Preferably, the horizontal conveying carriage is located under the receiving plate. The receiving plate has at least one gap at a position corresponding to that of the at least one banknote pressing arm of the banknote horizontal conveying carriage. When the receiving plate moves downwardly to a lowest position along the guide bar with the slider, the at least one banknote pressing arm passes through the at least one gap such that the receiving plate is aligned with the receiving surface of the banknote horizontal conveying carriage.

Preferably, the pressing mechanism further includes a motor mounted on the bracket, a driving gear cluster, a belt pulley and a driving belt. One end of the driving belt is disposed around the belt pulley, and the other end of the driving belt is disposed around the first rotating shaft. The power of the motor is transmitted to the cam via the driving gear cluster, the belt pulley and the driving belt in sequence.

The present application further provides a sorting-bundling integrated apparatus having any one of the banknote stacking and tidying modules described above. The apparatus further includes a banknote picking and separating module, a banknote identification module, a banknote conveying module and a banknote bundling module.

Since the cam is adopted to press the banknotes via the pressing rod after the cam rotates by a certain angle, there is no need for providing a linear pressing mechanism in the direction of the thickness of the stacked banknotes, thereby saving the space and reducing the volume of the equipment.

DETAILED DESCRIPTION OF THE INVENTION

In order to further illustrate the present application, the specific embodiments of the present application will be introduced in conjunction with the accompanying drawings.

Figure 1:
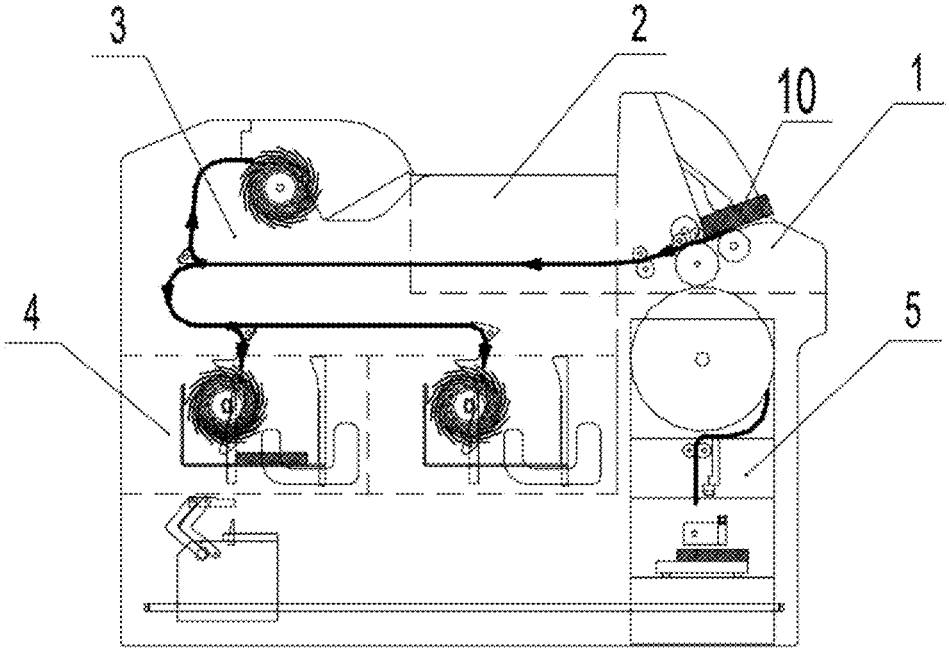
FIG. 1 is a module structural schematic view of a sorting-bundling integrated apparatus according to a preferred embodiment of the present application.

FIG. 1 shows a traveling path of banknotes 10 and various parts of a sorting-bundling integrated apparatus according to a preferred embodiment of the present application. The sorting-bundling integrated apparatus includes a banknote picking and separating module 1, a banknote identification module 2, a banknote conveying module 3, a banknote stacking and tidying module 4 and a banknote bundling module 5. Main functions of the various functional modules are as follows: the banknote picking and separating module 1 picks up one by one from a stack of banknotes 10 to be sorted, separates the banknotes from each other, and then conveys the separated banknotes into the sorting-bundling integrated apparatus; the banknote identification module 2 identifies the banknotes conveyed one by one in denomination, orientation, authenticity and the like, and estimates the thickness of the banknotes; the banknote conveying module 3 performs judgment upon other properties of the banknotes such as width, obliquity and spacing, conveys the counterfeit banknotes and those banknotes with unqualified properties into a withdraw area according to the results given by the banknote identification module 2, and conveys the genuine banknotes and the banknotes with qualified properties into respective banknote stacking areas according to banknote type, denomination, or new or used characteristics; the banknote stacking and tidying module 4 stacks and tidies the conveyed banknotes 10 firstly, and then presses tightly 100 pieces of the banknotes 10 stacked tidily and conveys the pressed banknotes into a bundling area; the banknote bundling module 5 bundles the banknotes 10 with a bundling tape, and then conveys the bundled banknotes to an outlet.

Figure 2:
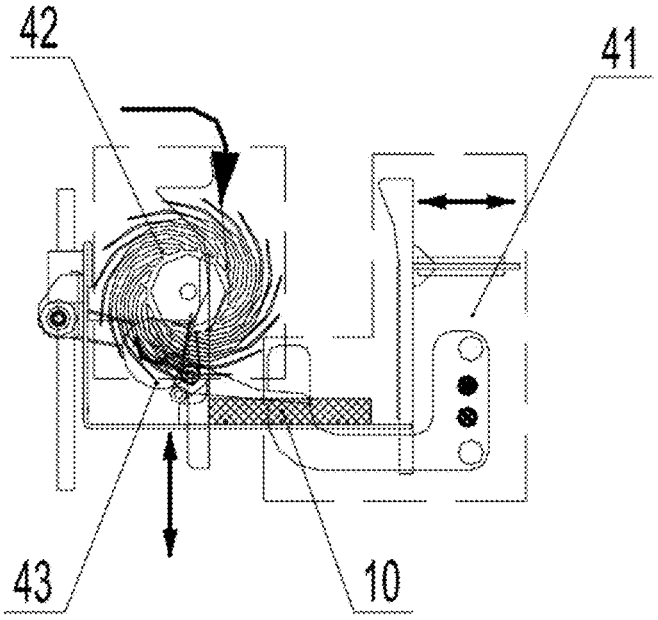
FIG. 2 is a structural schematic view of a banknote stacking and tidying module in the sorting-bundling integrated apparatus in FIG. 1.

The banknote stacking and tidying module 4, as shown in FIG. 2, includes: a banknote tidying sub-module 41 for defining and tidying banknotes along the directions of both the length and the width of the banknotes 10 in a banknote stacking process; a banknote stacking sub-module 42 for stacking banknotes entered into the banknote stacking area through a convey passage; and a banknote pressing and conveying sub-module 43 for pressing the banknotes and conveying the pressed banknotes downwardly and vertically after the banknotes have been stacked and tidied.

Figure 3:
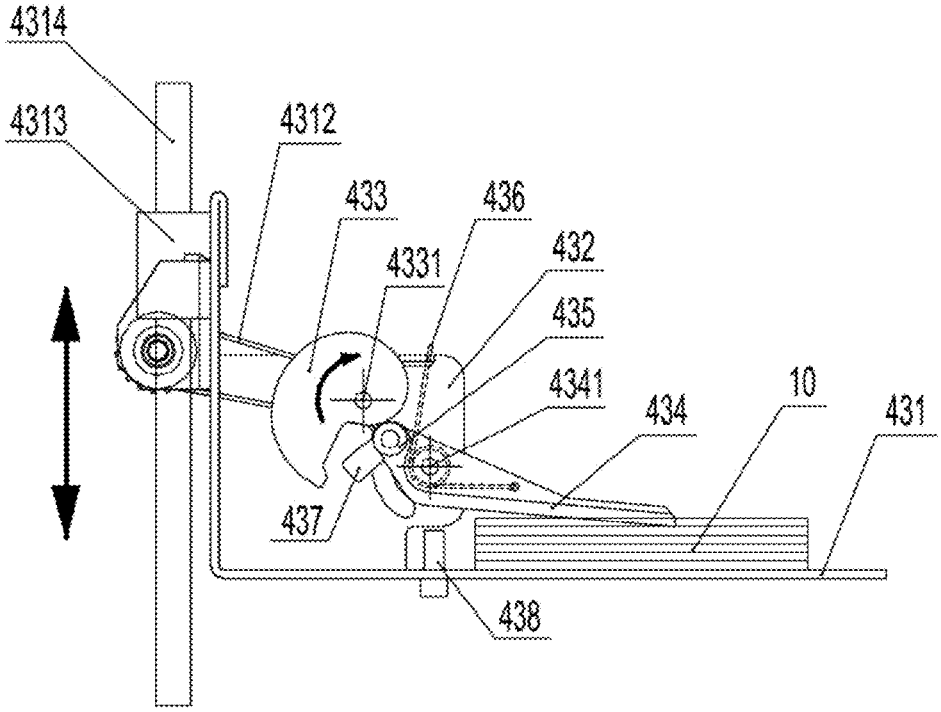
FIG. 3 is a structural schematic view of a pressing mechanism and a pressing mechanism vertical reciprocating movement unit in a banknote pressing and conveying sub-module in FIG. 2, with a pressing rod being in a pressing position.
Figure 4:
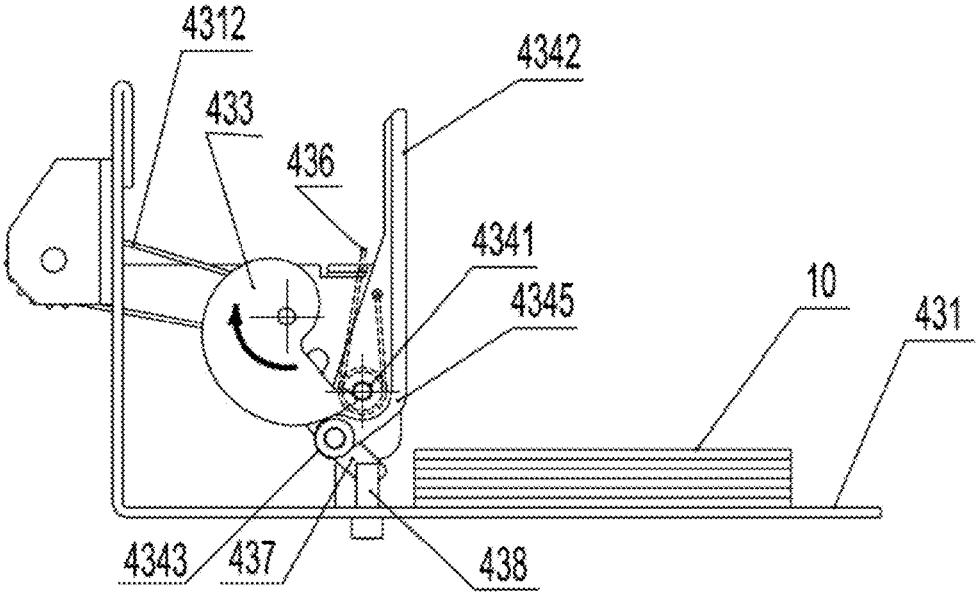
FIG. 4 is a structural schematic view of the pressing mechanism, with the pressing rod in a release position.
Figure 9:
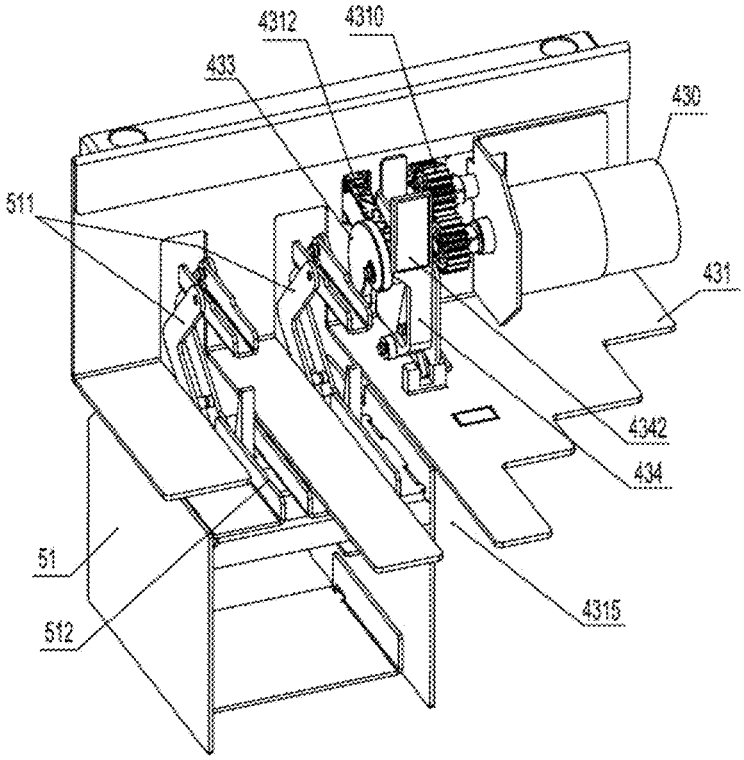
FIG. 9 is a perspective structural schematic view showing the cooperation between a banknote horizontal conveying carriage and the banknote pressing mechanism.

The banknote pressing and conveying sub-module 43 will be described in detail hereinafter. In conjunction with FIGS. 3, 4 and 9, the banknote pressing and conveying sub-module 43 includes a pressing mechanism, a pressing mechanism vertical reciprocating movement unit and a banknote horizontal conveying carriage 51. The pressing mechanism includes an 'L'-shaped receiving plate 431, a bracket 432 fixed on the receiving plate 431, a cam 433, a pressing rod 434 and a pressing spring 436. The cam 433 is rotatably mounted on the bracket 432 by means of a first rotating shaft 4331. The pressing rod 434 includes a pressing end 4342, a driving end 4343 and an articulating portion 4345 between the pressing end 4342 and the driving end 4343, and the articulating portion 4345 of the pressing rod 434 is articulated on the bracket 432 by means of a second rotating shaft 4341. The cam 433 is cooperated with the driving end 4343 of the pressing rod 434 and may drive the pressing rod 434 to rotate about the second rotating shaft 4341 between a release position and a pressing position. Specifically, in the present embodiment, a rolling wheel 435 is provided at the driving end 4343 of the pressing rod 434 and the rolling wheel 435 is in contact with the cam 433, wherein the rolling wheel 435 is driven to rotate by the rotation of the cam 433 and then drives the pressing rod 434 to rotate. One end of the pressing spring 436 is fixed on the bracket 432, and the other end is connected to the pressing end 4342 of the pressing rod 434 for applying an elastic force to the pressing rod 434 so as to press the banknotes tightly. The pressing mechanism vertical reciprocating movement unit includes a slider 4313 and a guide bar 4314. The slider 4313 is disposed around the guide bar 4314 such as to move upwardly and downwardly along the guide bar 4314. The receiving plate 431 is fixedly connected with the slider 4313 and may move upwardly and downwardly along the guide bar 4314 with the slider 4313. The banknote horizontal conveying carriage 51 includes a receiving surface 512 and a banknote pressing arm 511, and functions to receive and clamp the banknotes stacked and pressed and then convey the banknotes to the banknote bundling module horizontally. Specifically, the horizontal conveying carriage 51 is located underneath the receiving plate 431. The receiving plate 431 is provided with at least one gap 4315 at a position corresponding to that of the banknote pressing arm 511 of the banknote horizontal conveying carriage 51. When the receiving plate 431 moves downwardly to a banknote conveying position along the guide bar 4314 with the slider 4313, the banknote pressing arm 511 passes through the gap 4315 and the receiving plate 431 is aligned with the receiving surface 511 of the banknote horizontal conveying carriage 51, thus receiving and clamping the banknotes 10 smoothly.

Figure 5:
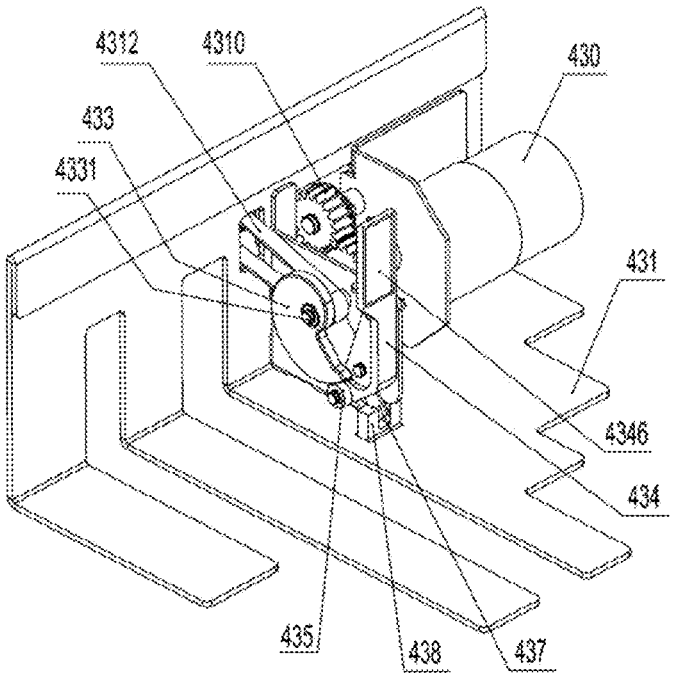
FIG. 5 is a perspective structural schematic view of the pressing mechanism.
Figure 6:
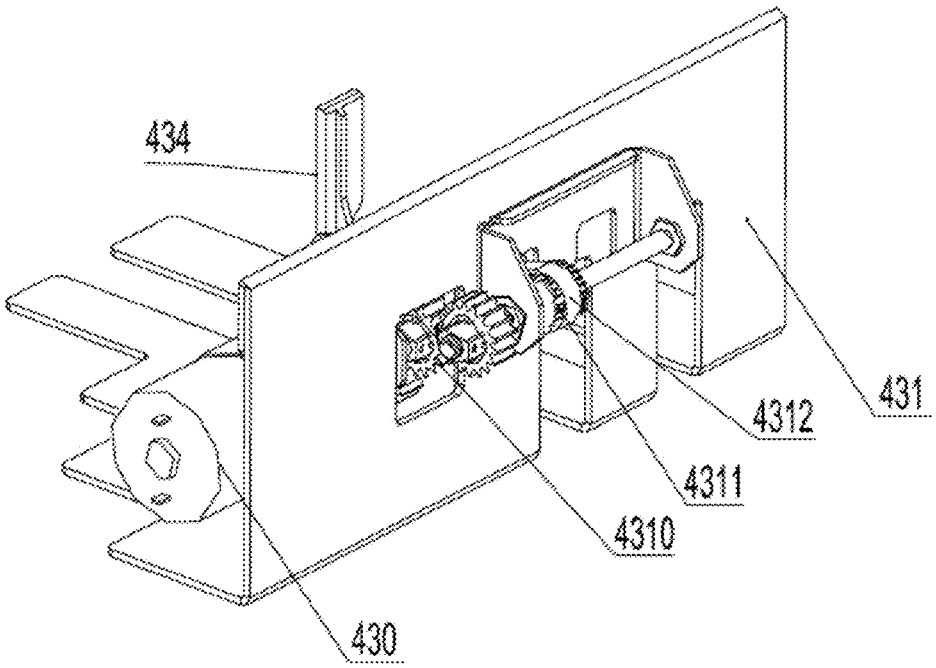
FIG. 6 is another perspective structural schematic view of the pressing mechanism in FIG. 5, with a driving part of a cam being mainly shown.

As shown in FIGS. 5 and 6, the pressing mechanism further includes a sensor assembly and a cam driving assembly. The cam driving assembly includes a motor 430 mounted on the bracket 432, a driving gear cluster 4310, a belt pulley 4311 and a driving belt 4312. One end of the driving belt 4312 is disposed around the belt pulley 4311, and the other end is disposed around the first rotating shaft 4331. The power of the motor 430 is transmitted to the cam 433 via the driving gear cluster 4310, the belt pulley 4311 and the driving belt 4312 in sequence. Certainly, such arrangement in the present embodiment is purposed to allow enough space for parts of the banknote stacking sub-module 42. In practical application, the power of the motor 430 may also be transmitted directly to the cam 433 by the gear transmission or the synchronous belt transmission.

The sensor assembly includes a sensing baffle 437 and a sensor body 438. The sensor body 438 may be an optical "U"-shaped sensor or a thru-beam sensor, and may be fixedly connected to the bracket 432 or the receiving plate 431. In the present embodiment, the sensor body 438 is fixedly mounted to the receiving plate 431. The sensing baffle 437 is fixedly connected to the driving end 4342 of the pressing rod 434 such as to move as the pressing rod 434 rotates, thereby blocking the optical path of the sensor body 438 selectively. That is, in the present embodiment, the sensor is utilized to assist in controlling the rotation or non-rotation of the motor, so as to switch the pressing rod 434 between a release position and a pressing position. In the present embodiment, when the pressing rod 434 is located at the pressing position, the sensing baffle 437 doesn't block the optical path of the sensor body 438; and as the pressing rod 434 rotates to the release position, the sensing baffle 437 rotates to a position at which the sensing baffle 437 blocks the optical path of the sensor body 438, and the motor 430 is controlled to stop.

Figure 7:
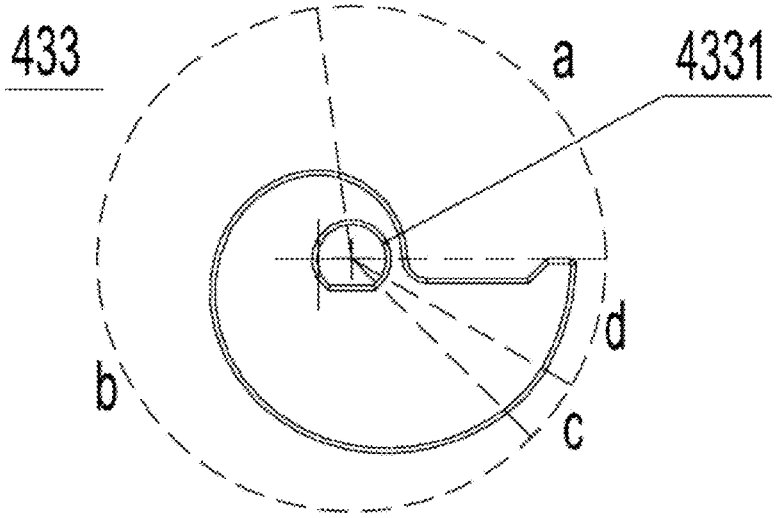
FIG. 7 is a schematic view of a peripheral outline of the cam.

As shown in FIG. 7, in the present embodiment, the cam 433 has a discontinuity outline which includes in sequence a first arc "a", an involute "b" tangent to the first arc "a", a second arc "c" tangent to the involute "b", and a third arc "d", wherein there is an abrupt transition between the third arc "d" and the first arc "a". The cam 433 is cooperated with the driving end 4342 of the pressing rod 434. In the present embodiment, the cam 433 is in contact with a rolling wheel 435 arranged on the driving end 4342, i.e. in the operating process, the rolling wheel 435 rotates along the outline of the cam 433. The motor 430 controls the cam 433 to rotate clockwise. When the first arc "a" of the cam comes into contact with the rolling wheel 435, i.e. when the cam comes into contact with the rolling wheel 435 at the smallest radius of the cam, the pressing rod 434 is in a pressing position. As the cam 433 keeps on rotating clockwise, the radius of the outline of the cam 433 at which the cam 433 is in contact with the rolling wheel 435 becomes larger and larger, and thus a driving force is provided to the rolling wheel to cause the rolling wheel 435 to rotate anticlockwise, i.e. to drive the pressing rod 434 to rotate anticlockwise. Specifically, the pressing end 4342 of the pressing rod 434 cocks upwardly, and the pressing rod 434 reaches the release position gradually. When the pressing rod 434 reaches the stable release position, the third arc "d" of the cam 433 comes into contact with the rolling wheel 435, i.e. the cam 433 comes into contact with the rolling wheel 435 at the maximum radius of the outline of the cam 433. At this point, as mentioned above, the sensing baffle 437 rotates to a position at which the sensing baffle 437 blocks the optical path of the sensor body 438, and the motor 430 stops running, so that the pressing rod 434 stays at the release position to wait for the banknote stacking sub-module 42 and the banknote tidying sub-module 41 to tidy and stack the banknotes. After 100 pieces of banknotes are tidied and stacked, the motor 310 is controlled to continue to rotate clockwise, and the cam 433 continues to rotate clockwise as well. As a result, the portion of the cam 433 in contact with the rolling wheel 435 is switched from the third arc "d" to the first arc "a", and the pressing rod 434 returns to the pressing position under the action of the pressing spring 436, allowing the pressing rod 434 to press the banknotes. After the action of pressing the banknotes is finished, the cam 433 continues to rotate clockwise, and the rolling wheel 435 is driven to rotate anticlockwise, so that the pressing rod 434 rotates to the release position again. As such, the pressing mechanism operates repeatedly.

It has to be noted that the centre of the base circle of the involute "b" is the axle center of the first rotating shaft 4331, and the center of the third arc "d" coincides with the center of the base circle of the involute "b". Thus, the pressing rod 434 reaches the release position, i.e. when the motor 430 driving the pressing rod 434 stops running, the pressing rod 434 may stay at the release position.

Figure 10:
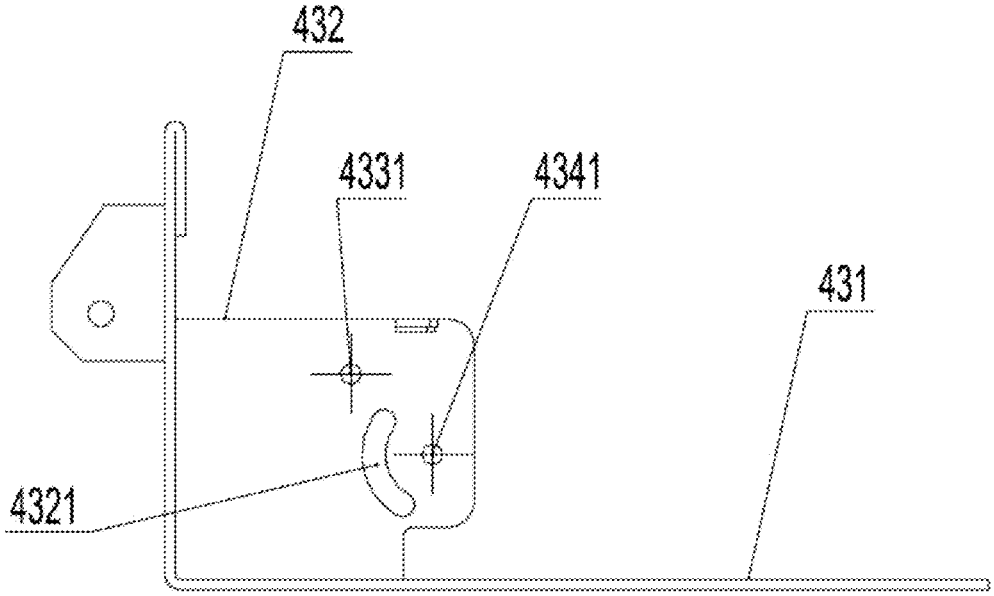
FIG. 10 is a structural schematic view of a bracket provided with a travel constraint groove.

Certainly, optionally, as shown in FIG. 10, a travel constraint groove 4321 may be provided on the bracket 432, and the driving end of the pressing rod 434 is provided with a boss projecting into the travel constraint groove 4321. Thus, when the pressing rod 434 rotates about the second rotating shaft 4341, its rotation travel is constrained within the scope defined by the travel constraint groove 4321, that is to say, the pressing rod 434 is fixed at the release position or the pressing position by respective ends of the travel constraint groove 4321, without excessive rotation about the second shaft 4341.

As shown in FIG. 5, preferably, the portion 4346 of the pressing end 4342 of the pressing rod 434 for pressing banknotes is a small flat plate, and the bottom of the small flat plate is concaved slightly for bonding a material such as EVA foam with a greater frictional coefficient than that of the pressing rod, so as to increase the frictional force between the pressing rod 434 and the banknotes 10, thus pressing the banknotes better without loosening or shifting.

Further, in the present embodiment, the pressing spring 436 is a torsion spring which is disposed around the second rotating shaft 4341, with one end of the torsion spring 436 abutting against the bracket 432 and the other end abutting against the pressing end 4342 of the pressing rod 434. However, the present application is not limited to adopt the torsion spring, and springs in other forms may also be applicable so long as a pressing force can be provided to the pressing end 4342 of the pressing rod 434.

Hereinafter, an operating process of the banknote stacking and tidying module will be described in conjunction with FIGS. 8*a* to 8*d*.

Figure 8A:
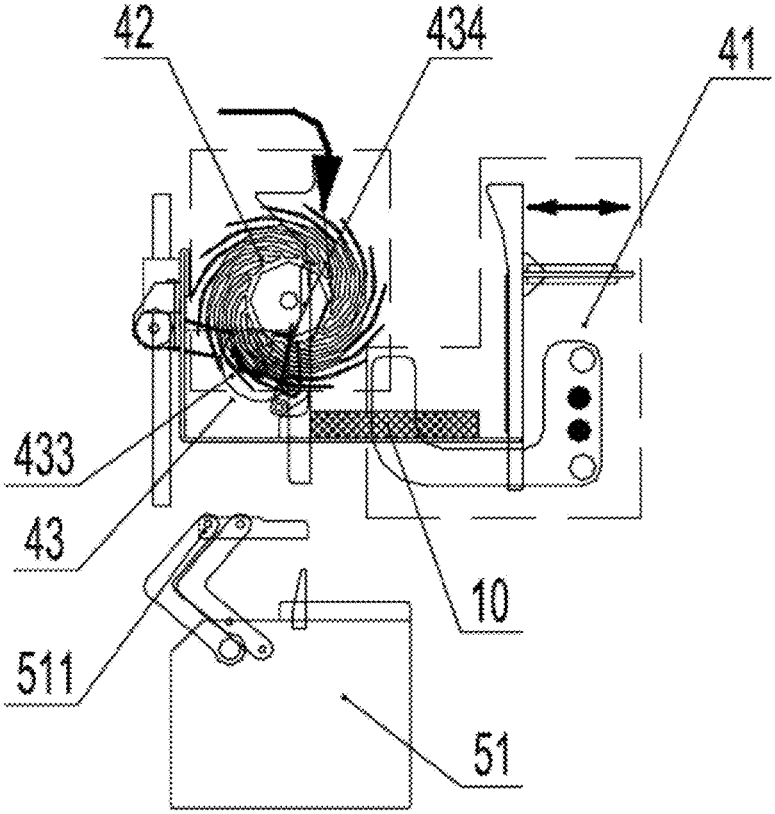
FIGS. 8*a*-8*d* are a schematic view of a process in which banknotes are stacked, tidied, pressed and conveyed to the banknote bundling module by the banknote tidying and conveying module.

As shown in FIG. 8*a*, the cam 433 in the banknote pressing and conveying sub-module 43 rotates clockwise to drive the pressing rod 434 to reach an upper limit position, i.e. the release position, and the pressing rod 434 may be hidden in the banknote stacking sub-module 42. Then, the banknotes can be conveyed into the banknote stacking sub-module 42 and are stacked therein, and at the same time, the banknotes are tidied by the banknote tidying sub-module 41 in directions of the length and the width of the banknotes.

Figure 8B:
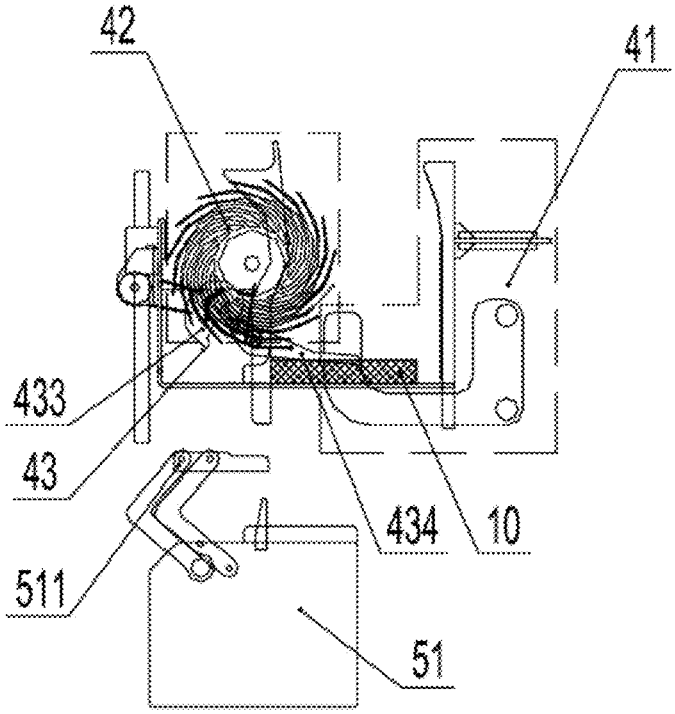

As shown in FIG. 8*b*, after the stacking and the tidying of the banknotes is finished, the cam 433 in the banknote pressing and conveying sub-module 43 rotates clockwise, and, cooperating with the action of the pressing spring 436, drives the pressing rod 434 to turn into the lower limit position, i.e. the pressing position, to press the banknotes. It is ready for conveying the banknotes downwardly.

Figure 8C:
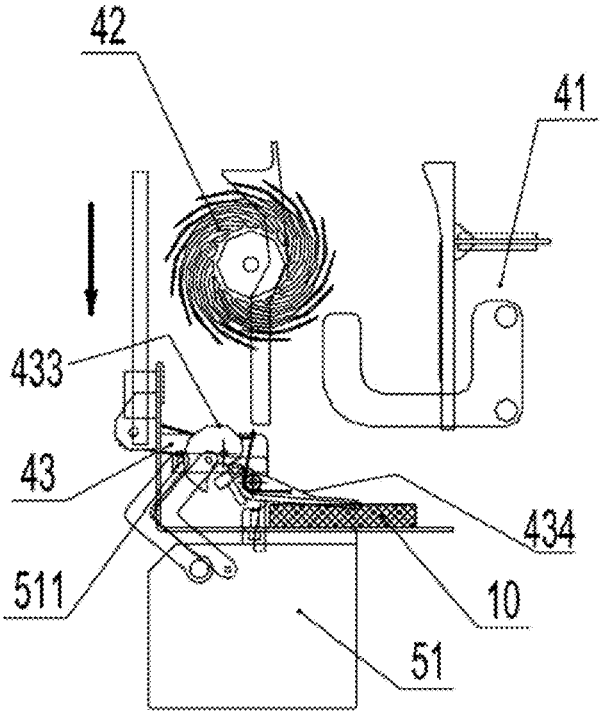

As shown in FIG. 8*c*, the banknote pressing and conveying sub-module 43 moves linearly and downwardly to the banknote conveying carriage 51, such that the receiving plate 431 is aligned with the receiving surface 511 of the banknote horizontal conveying carriage 51. At this moment, the pressing rod 434 still presses the banknotes, while the banknote pressing arm 511 of the banknote conveying carriage 51 is in a release state.

Figure 8D:
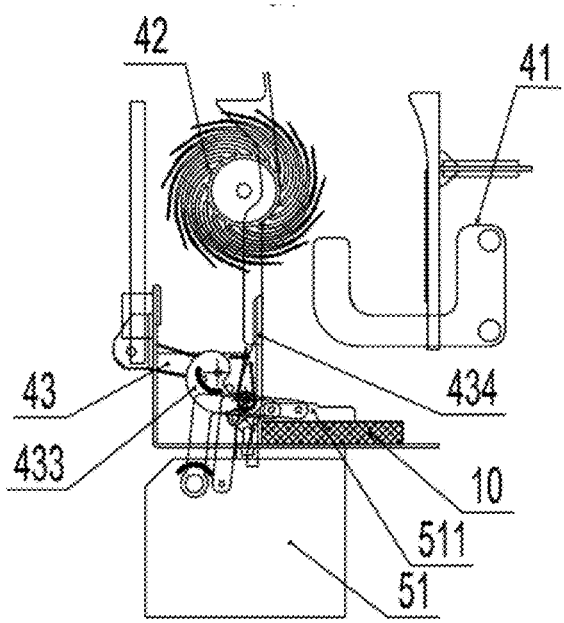

As shown in FIG. 8*d*, the banknote pressing arm 511 of the banknote conveying carriage 51 rotates clockwise to press the banknotes 10, and the cam 433 rotates clockwise to drive the pressing rod 434 back to the release position. Subsequently, the banknote conveying carriage 51 carries the banknotes and moves horizontally rightwards into a bundling area, and after the banknote conveying carriage 51 enters into the bundling area, the banknote pressing and conveying sub-module 43 moves upwardly to return to the banknote stacking position described above. Till then, the handover of the banknotes is finished.

The banknote pressing and conveying sub-module 43 of the banknote stacking and tidying module 4 adopts the cam 433 to press the banknotes via the pressing rod 434 after the cam 433 rotates by a certain angle, without providing a linear pressing mechanism in the direction of the thickness of the stacked banknotes, thereby saving the space and reducing the volume of the equipment.

The sorting-bundling integrated apparatus adopting the banknote stacking and tidying module 4 has the advantage of a reduced volume, and has the extremely effective banknote pressing mechanism.

The above description is only preferred embodiments of the present application. It should be noted that, the above preferred embodiments are not intended to limit the present application, and the protection scope of the present application is defined by claims of the present application. For the person skilled in the art, many modifications and improvements may be made to the present application without departing from the spirit and scope of the present application, and these modifications and improvements are also deemed to fall into the protection scope of the present application.

The invention claimed is:

1. A banknote stacking and tidying module comprising a banknote tidying sub-module, a banknote stacking sub-module, and a banknote pressing and conveying sub-module, wherein the banknote pressing and conveying sub-module comprises:

a pressing mechanism comprising a receiving plate, a bracket fixed on the receiving plate, a cam, a pressing rod and a pressing spring, wherein the cam is rotatably mounted on the bracket by means of a first rotating shaft, the pressing rod comprises a pressing end, a driving end and an articulating portion between the pressing end and the driving end, the articulating portion of the pressing rod is articulated on the bracket by means of a second rotating shaft, the cam is cooperated with the driving end of the pressing rod to drive the pressing rod to rotate about the second rotating shaft between a release position and a pressing position, one end of the pressing spring is fixed on the bracket, and the other end of the pressing spring is connected to the pressing end of the pressing rod for applying an elastic force to the pressing rod to press banknotes tightly;

a pressing mechanism vertical reciprocating movement unit comprising a slider and a guide bar, wherein the slider is disposed around the guide bar so as to move upwardly and downwardly along the guide bar, the receiving plate is fixedly connected with the slider so as to allow the pressing mechanism to move upwardly and downwardly along the guide bar together with the slider; and a banknote horizontal conveying carriage comprising a receiving surface and at least one banknote pressing arm, and adapted to receive and clamp the banknotes stacked and pressed and to convey the banknotes to a banknote bundling module horizontally.

2. The banknote stacking and tidying module according to claim 1, wherein the cam has a discontinuity outline comprising, in sequence, a first arc, an involute tangent to the first arc, a second arc tangent to the involute, and a third arc, and wherein a centre of a base circle of the involute is an axle center of the first rotating shaft, and a center of the third arc coincides with the center of the base circle of the involute.

3. The banknote stacking and tidying module according to claim 1, wherein a rolling wheel is provided at the driving end of the pressing rod and is in contact with the cam.

4. The banknote stacking and tidying module according to claim 1, wherein the pressing spring is a torsion spring disposed around the second rotating shaft, with one end of the torsion spring abutting against the bracket and the other end of the torsion spring abutting against the pressing end of the pressing rod.

5. The banknote stacking and tidying module according to claim 1, wherein a portion of the pressing end of the pressing rod for pressing the banknotes is a small flat plate, the bottom of the flat plate is concaved slightly for bonding a material with a greater frictional coefficient than that of the pressing rod.

6. The banknote stacking and tidying module according to claim 1, wherein a travel constraint groove is provided in the bracket, the driving end of the pressing rod is provided with a boss projecting into the travel constraint groove, and the pressing rod is limited at the release position or the pressing position by a corresponding end of the travel constraint groove.

7. The banknote stacking and tidying module according to claim 1, wherein the banknote pressing and conveying sub-module further comprises a sensor comprising a sensing baffle and a sensor body, and wherein the sensor body is an optical "U"-shaped sensor or a thru-beam sensor and is fixedly connected to the bracket or the receiving plate, and the sensing baffle is fixedly connected to the driving end of the pressing rod and moves as the pressing rod rotates, so as to block an optical path of the sensor body selectively.

8. The banknote stacking and tidying module according to claim 1, wherein the horizontal conveying carriage is located under the receiving plate, the receiving plate has at least one gap at a position corresponding to that of the at least one banknote pressing arm of the banknote horizontal conveying carriage, and when the receiving plate moves downwardly to a lowest position along the guide bar with the slider, the at least one banknote pressing arm passes through the at least one gap such that the receiving plate is aligned with the receiving surface of the banknote horizontal conveying carriage.

9. The banknote stacking and tidying module according to claim 1, wherein the pressing mechanism further comprises a motor mounted on the bracket, a driving gear cluster, a belt pulley and a driving belt, and wherein one end of the driving belt is disposed around the belt pulley, the other end of the driving belt is disposed around the first rotating shaft, and the power of the motor is transmitted to the cam via the driving gear cluster, the belt pulley and the driving belt in sequence.

10. A sorting-bundling integrated apparatus comprising a banknote picking and separating module, a banknote identification module, a banknote conveying module, a banknote bundling module, and a banknote stacking and tidying module, which comprises a banknote tidying sub-module, a banknote stacking sub-module, and a banknote pressing and conveying sub-module, wherein the banknote pressing and conveying sub-module comprises:

a pressing mechanism comprising a receiving plate, a bracket fixed on the receiving plate, a cam, a pressing rod and a pressing spring, wherein the cam is rotatably mounted on the bracket by means of a first rotating shaft, the pressing rod comprises a pressing end, a driving end and an articulating portion between the pressing end and the driving end, the articulating portion of the pressing rod is articulated on the bracket by means of a second rotating shaft, the cam is cooperated with the driving end of the pressing rod to drive the pressing rod to rotate about the second rotating shaft between a release position and a pressing position, one end of the pressing spring is fixed on the bracket, and the other end of the pressing spring is connected to the pressing end of the pressing rod for applying an elastic force to the pressing rod to press banknotes tightly;

a pressing mechanism vertical reciprocating movement unit comprising a slider and a guide bar, wherein the slider is disposed around the guide bar so as to move upwardly and downwardly along the guide bar, the receiving plate is fixedly connected with the slider so as to allow the pressing mechanism to move upwardly and downwardly along the guide bar together with the slider; and a banknote horizontal conveying carriage comprising a receiving surface and at least one banknote pressing arm, and adapted to receive and clamp the banknotes stacked and pressed and to convey the banknotes to a banknote bundling module horizontally.

* * * * *